US007195809B2

(12) United States Patent
Weaver et al.

(10) Patent No.: US 7,195,809 B2
(45) Date of Patent: Mar. 27, 2007

(54) FLEXIBLE CARRIER

(75) Inventors: William N. Weaver, Northbrook, IL (US); JoanRita A. Schultz, Barrington, IL (US); Peter L. Samaras, Elk Grove Village, IL (US); Deepak H. Mehta, Naperville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 387 days.

(21) Appl. No.: 10/762,202

(22) Filed: Jan. 21, 2004

(65) Prior Publication Data

US 2004/0192850 A1 Sep. 30, 2004

Related U.S. Application Data

(60) Provisional application No. 60/442,313, filed on Jan. 24, 2003.

(51) Int. Cl.
*B32B 3/24* (2006.01)
*B65D 75/42* (2006.01)

(52) U.S. Cl. ..... 428/131; 428/523; 206/145; 206/150

(58) Field of Classification Search ..... 428/131, 428/523; 206/145, 150
See application file for complete search history.

(56) References Cited

U.S. PATENT DOCUMENTS

| | | | | |
|---|---|---|---|---|
| 3,778,096 | A | 12/1973 | Smith | |
| 4,116,331 | A | 9/1978 | Curry et al. | |
| 4,121,712 | A | 10/1978 | Cunningham | |
| 4,201,322 | A | 5/1980 | Crawford | |
| 4,219,117 | A | 8/1980 | Weaver et al. | |
| 4,367,841 | A | 1/1983 | Mazumdar | |
| 4,385,691 | A | 5/1983 | Klygis | |
| 4,574,949 | A | 3/1986 | Rhoads | |
| 4,709,808 | A | 12/1987 | Balduff et al. | |
| 4,740,415 | A | 4/1988 | Hirschberger | |
| 4,795,767 | A | 1/1989 | Turczyk et al. | |
| 4,872,549 | A | 10/1989 | Panzzolo | |
| 4,915,217 | A | 4/1990 | Karabedian et al. | |
| 5,154,289 | A | 10/1992 | Van Erden | |
| 5,538,790 | A | 7/1996 | Arvedson et al. | |
| 5,789,029 | A | 8/1998 | Ramsey et al. | |
| 5,962,092 | A | 10/1999 | Kuo et al. | |
| 6,006,902 | A | 12/1999 | Weaver | |
| 6,056,115 | A | 5/2000 | Olsen | |
| 6,234,945 | B1 | 5/2001 | Weaver | |
| 6,598,738 | B2 | 7/2003 | Weaver | |
| 2002/0011423 | A1 | 1/2002 | Weaver | |
| 2004/0147679 | A1 * | 7/2004 | Weaver et al. | 525/240 |

* cited by examiner

*Primary Examiner*—William P. Watkins, III
(74) *Attorney, Agent, or Firm*—Pauley Petersen & Erickson

(57) ABSTRACT

A flexible carrier for carrying a plurality of containers, such as soft drink and other beverage containers, is formed from a polymer composition which provides the carrier with improved recovery, tensile strength and tear resistance. The polymer composition includes about 50–99% by weight of a low density ethylene polymer having a density of about 0.910–0.950 grams/cm$^3$ and about 1–50% by weight of a single site catalyzed ethylene-alpha olefin copolymer plastomer having a density of about 0.850–0.905 grams/cm$^3$.

36 Claims, 1 Drawing Sheet

FLEXIBLE CARRIER

CROSS REFERENCE TO RELATED APPLICATIONS

This application claims the benefit of U.S. Provisional Application No. 60/442,313, filed on 24 Jan. 2003.

FIELD OF THE INVENTION

This invention relates to a flexible carrier for carrying a plurality of containers such as bottles and cans used for beverages.

BACKGROUND OF THE INVENTION

Flexible carriers (often referred to as multi-packaging devices) are used to carry a plurality of containers. Typical containers include bottles, cans and other containers having a sidewall and a chime or raised rib around an upper portion of the container. Conventional carriers include multi-packaging devices that engage the chime or rib around the upper portion of the container. Another conventional carrier is the side wall applied carrier, wherein the multi-packaging device engages the sidewall of the containers.

Flexible carriers are applied to containers by stretching the carrier around the diameter of the container, and allowing the stretched carrier to recover, providing a tight fit. The carrier is typically applied to the chime or rib, where this structure exists, or to the main sidewall where no chime or rib exists. If the container engaging portion of the carrier is stretched too much during application, it may "neck down" and not adequately recover, leading to package failure. If the aperture is too large and the container engaging portion is not stretched enough, it may not develop enough tension to adequately engage the container, leading to package failure.

Another situation that may lead to package failure is the notching or scratching of the flexible carrier. Small notches or scratches may propagate into larger tears due to the weight of the package, causing a can or bottle to dislodge.

There is a need or desire for a flexible carrier made from a material that has improved recovery, improved elongation at break, and is less prone to tear when notched or scratched.

SUMMARY OF THE INVENTION

The present invention is directed to a flexible carrier for containers, which has improved recovery after stretch, improved elongation at break, and is more resistant to tearing when notched or scratched. The flexible carrier is formed using a polymer blend which includes the following components:

a) about 50–99% by weight of a low density polyethylene polymer including about 80 to 100% by weight ethylene and 0 to about 20% by weight of a carbon monoxide comonomer;

b) about 1–50% by weight of an ethylene-alpha olefin plastomer having a density of about 0.850–0.905 grams/cm$^3$ and prepared using a single-site catalyst.

The flexible carrier includes a plastic sheet formed using the polymer blend, and including a plurality of openings for surrounding and holding the containers. Each opening is surrounded by a portion of the flexible carrier defined as a container engaging portion.

DETAILED DESCRIPTION OF THE PRESENTLY PREFERRED EMBODIMENTS

Figure 1:
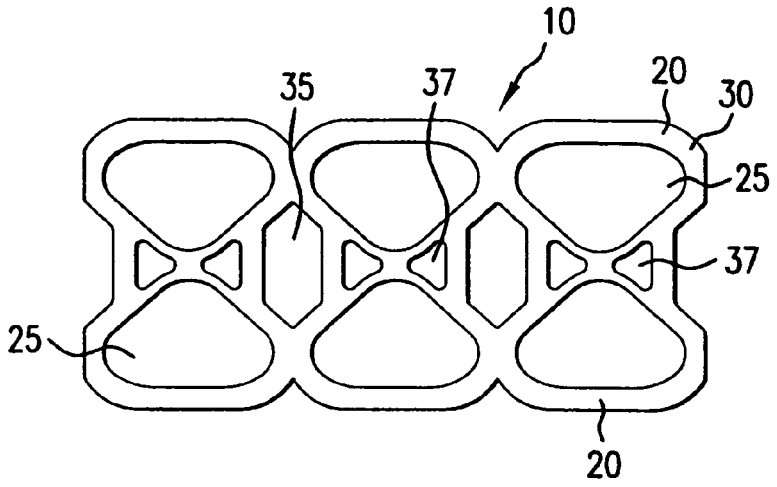
FIG. 1 is a plan view of one embodiment of a flexible carrier, which may be constructed according to the invention.
Figure 2:
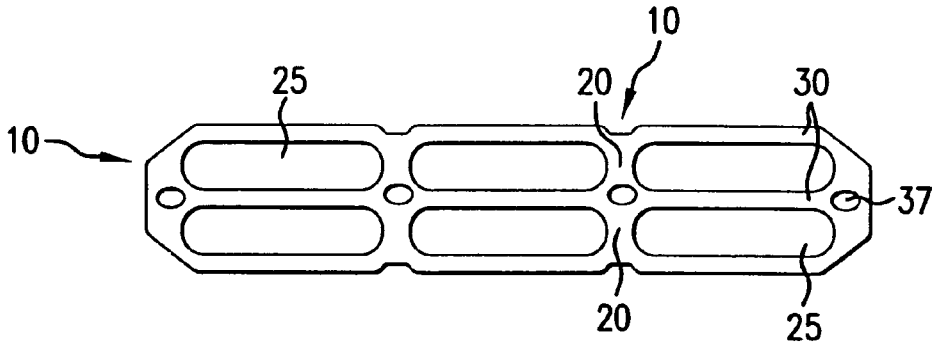
FIG. 2 is a plan view of another embodiment of a flexible carrier, which may be constructed according to the invention.
Figure 3:
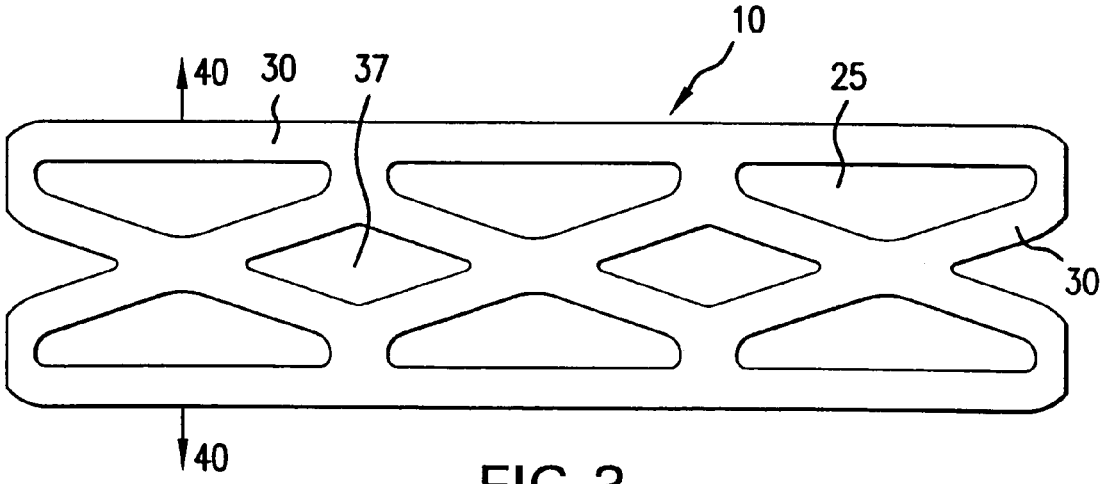
FIG. 3 is a plan view of another embodiment of a flexible carrier, which may be constructed according to the invention.

FIGS. 1–3 illustrate possible structures for the flexible carrier of the invention. The illustrations are exemplary, and the invention is not limited to the flexible carriers shown. Each flexible carrier 10 includes a flexible sheet 20 defining a plurality of primary apertures 25 for receiving containers. The primary apertures may have a diameter or width of about 0.20 inch or greater, large enough that the carrier can be stretched without tearing to accommodate containers. Each primary aperture 25 is surrounded by a portion 30 of the flexible carrier referred to as a carrier receiving portion. Secondary apertures 35, 37 may also be provided between the primary apertures. The secondary apertures 35 may be used as handles for the flexible carrier once the containers have been inserted into the primary apertures 25. The secondary apertures 35 and 37 may be used to reduce material cost, and to control or modify the size and stretching properties of the carrier receiving portions 30.

The containers to be inserted in the primary apertures 25 may be bottles or cans having varying shapes and diameters. Referring to FIG. 3, for instance, each flexible carrier 10 is installed on containers by stretching the carrier receiving portions 30 in the cross direction, in opposing fashion, as indicated by arrows 40. The carrier receiving portions are installed around the containers while stretched, and are allowed to retract (recover) to provide a snug fit around the rib, chime or outside surface of the containers. The plan view dimensions of the flexible carrier 10, and its components, vary according to the end use. Particular end uses include without limitation soft drink and beverage cans and bottles of various sizes and shapes.

The flexible sheet 20 used to form the flexible carrier 10 is desirably a plastic film, which can be formed by an extrusion process and then cut to form the flexible carrier. The flexible sheet 20 has a thickness which provides sufficient structural integrity to carry a desired number of containers. For instance, each flexible carrier 10 may be designed to carry two, four, six, eight, ten or twelve containers of a desired product having a specific weight, volume, shape and size. For most applications, the flexible sheet 20 may have a thickness of about 3–50 mils, suitably about 5–30 mils, commonly about 10–20 mils.

The flexible sheet 20 used to form the flexible carrier 10 is formed using a polymer composition which includes a high pressure low density polyethylene polymer and a single-site catalyzed ethylene-alpha olefin plastomer. The composition provides the carrier 10 with improved recovery after stretch, improved elongation and strength at break, and improved resistance to tearing when the carrier is notched or scratched, compared to an otherwise similar carrier made using the high pressure low density polyethylene polymer alone. Elongation at break and strength at break are measured using the stress-strain test described in ASTM D882-91, which procedure is incorporated by reference. Recovery after stretch, notch sensitivity and scratch sensitivity can be measured using various standard and specialized procedures.

The polymer blend used to form the flexible carrier includes about 50–99% by weight of a low density polyethylene polymer. Desirably, this polymer is branched, and is prepared using a conventional high pressure polymerization process. The low density polyethylene polymer may be prepared using a Ziegler-Natta catalyst or a single-site catalyst system. The low density polyethylene polymer may be a homopolymer, or a copolymer of ethylene with one or more $C_3$ to $C_{12}$ alpha-olefin comonomers and/or carbon monoxide. Desirably, the low density polyethylene polymer includes a carbon monoxide comonomer, which makes the carrier more prone to degradation in the presence of ultraviolet light. Suitably, the polymer blend includes about 70–97% by weight of the low density polyethylene polymer, desirably about 80–95% by weight of the low density polyethylene polymer.

The desired amount of carbon monoxide comonomer in the low density polyethylene polymer varies depending on the percentage of the low density polyethylene polymer in the polymer blend composition. When present, the carbon monoxide comonomer may constitute about 0.1–20% by weight of the low density polyethylene polymer, suitably about 0.5–10% by weight, desirably about 1–4% by weight. When considered as a percentage of the polymer blend composition, the carbon monoxide comonomer may constitute about 0.1–10% by weight, suitably about 0.5–5% by weight, desirably about 1–2% by weight.

The low density polyethylene polymer should have a density of about 0.910–0.950, grams/cm$^3$, suitably about 0.920–0.940 grams/cm$^3$, desirably about 0.925–0.935 grams/cm$^3$. In other words, the term "low density polyethylene polymer" includes polyethylene polymers commonly considered as having medium density, as well as polyethylene polymers commonly considered as having low density. The low density polyethylene polymer should have a melt index of about 0.2–3.0 grams/10 min., suitably about 0.3–1.5 grams/10 min., desirably about 0.4–0.7 grams/10 min., measured at 190° C. using ASTM D1238.

The polymer blend used to form the flexible carrier also includes about 1–50% by weight of an ethylene-alpha olefin copolymer plastomer having a density of about 0.850–0.905 grams/cm$^3$, and prepared using a single-site catalyst. Suitably, the plastomer has a density of about 0.865–0.895 grams/cm$^3$, desirably about 0.880–0.890 grams/cm$^3$. The alpha-olefin comonomer may have 3–12 carbon atoms, desirably 4–8 carbon atoms. The amount of the comonomer is whatever is required to achieve the desired plastomer density. Generally, the ethylene-alpha olefin copolymer plastomer includes about 5–30% by weight of the comonomer, suitably about 10–25% by weight. Suitably, the polymer blend includes about 3–30% by weight of the plastomer, desirably about 5–20% by weight of the plastomer.

The single-site catalyzed ethylene-alpha olefin copolymer plastomer may have a melt index of about 0.3–10 grams/10 min., suitably about 0.5–5 grams/10 min., desirably about 0.8–1.3 grams/10 min., measured at 190° C. using ASTM D1238. Suitable single-site catalyzed ethylene-alpha olefin copolymer plastomers are available from Exxon-Mobil Chemical Co. under the trade name EXACT, and from Dow Chemical Co. under the trade names AFFINITY and ENGAGE. Examples of suitable plastomers are described in U.S. Pat. No. 5,538,790, issued to Arvedson et al., and in U.S. Pat. No. 5,789,029, issued to Ramsey et al., the disclosures of which are incorporated by reference.

As described in U.S. Pat. No. 5,538,790, the single-site catalyzed ethylene-alpha olefin copolymer plastomer may be further characterized as one which has a solubility distribution breadth index (SDBI) in the range of about 10–35° C., a storage modulus in the range of about $2\times10^6$ to about $2\times10^7$ dynes/cm$^2$, and a molecular weight distribution of about 7 or less. Representative alpha-olefin comonomers include 1-butene, 1-pentene, 1-hexene, 4-methyl pentene-1, 1-octene, 1-decene, 1-dodecene and the like, as well as multiply-branched olefins such as 3,3,5 trimethylhexene-1 and the like. The molecular weight distribution of the plastomer is suitably about 2–4, desirably about 2–3. The SDBI of the plastomer is suitably about 10–25° C., desirably about 15–20° C., preferably about 15–18° C. These polymers may be produced by various processes, including without limitation gas phase, high pressure, solution, bulk, and slurry polymerization techniques.

As described in U.S. Pat. No. 5,789,029, the single-site catalyzed ethylene-alpha olefin copolymer plastomer may be further characterized as having a melt flow ratio of at least 5.63, a molecular weight distribution not greater than the melt flow ratio minus 4.63, and a critical shear rate at the onset of surface melt fracture at least 50% greater than the critical shear rate at the onset of surface melt fracture of a homogeneously or heterogeneously branched linear ethylene polymer having about the same melt index and molecular weight distribution. The polymers are described as "substantially linear" to distinguish over linear ethylene polymers. Substantially linear polymers are defined as having 0.01 to 3 long chain branches (of at least about 6 carbons) per 1000 carbon atoms. These polymers may also be produced by different processes including solution polymerization and gas phase polymerization.

The following table lists exemplary combinations of low density polyethylene polymer and single-site catalyzed ethylene alpha olefin plastomer useful to form the flexible carrier composition of the invention.

TABLE 1

Flexible Carrier Compositions
I. 90% by weight ethylene-carbon monoxide copolymer, having a density of 0.928–0.932 grams/cm$^3$, a melt index (190° C.) of 0.42–0.62 grams/10 min., and a carbon monoxide content of 1.75–2.05% by weight, and
II. 10% by weight single-site catalyzed ethylene-alpha olefin copolymer plastomer, selected from the following:

| Plastomer Type | Density (grams/cm$^3$) | Melt Index (190° C., grams/10 min) | Comonomer |
|---|---|---|---|
| EXACT 4033 | 0.880 | 0.8 | Butene |
| EXACT 4049 | 0.873 | 4.5 | Butene |
| EXACT 4056 | 0.883 | 2.2 | Hexene |
| AFFINITY 8150 | 0.868 | 0.5 | Octene |
| AFFINITY 8100 | 0.870 | 1.0 | Octene |
| AFFINITY 8770 | 0.885 | 1.0 | Octene |
| AFFINITY 1450 | 0.902 | 7.5 | Octene |
| ENGAGE 8200 | 0.870 | 5.0 | Octene |

The polymer blend composition used in the flexible carrier includes two primary polymer components as described above in the stated percentage ranges, with or without other polymer components, provided that the important physical properties of the flexible carrier described above are substantially maintained. For instance, the ethylene-carbon monoxide copolymer which destabilizes the carrier against ultraviolet radiation may be provided separately, in the form of a masterbatch or concentrate having a higher carbon monoxide content, or some or all of the carbon monoxide may be copolymerized with the single-site catalyzed ethylene alpha olefin plastomer. Regardless of how the carbon monoxide is introduced and affiliated, the polymer blend should have a carbon monoxide content of about 0.1–10% by weight, suitably about 0.5–5% by weight, desirably about 1–2% by weight. Other polymers may also be added in amounts which substantially maintain or enhance the recovery, elongation, tensile strength, and tear resistance of the flexible carrier, and/or which provide the carrier with cold temperature resistance, stress crack resistance, enhanced clarity and other desirable properties. The polymer components may be dry blended and/or melt blended together. Typically, they are fed separately to the extruder which forms the flexible carrier sheet, and are melt blended in the extruder.

While the embodiments of the invention described herein are presently preferred, various modifications and improvements can be made without departing from the spirit and scope of the invention. The scope of the invention is indicated by the appended claims, and all changes which fall within the meaning and range of equivalents are intended to be embraced therein.

We claim:

1. A flexible carrier for carrying a plurality of containers, comprising a flexible sheet and a plurality of primary apertures formed in the sheet for receiving portions of the containers, the flexible sheet comprising a polymer composition which includes:

about 50–99% by weight of a branched low density polyethylene polymer having a density of about 0.910–0.950 grams/cm$^3$ and prepared using a high pressure polymerization process; and about 1–50% by weight of a single-site catalyzed ethylene-alpha olefin copolymer plastomer having a density of about 0.850–0.905 grams/cm$^3$.

2. The flexible carrier of claim 1, wherein the branched low density polyethylene polymer comprises a polyethylene homopolymer.

3. The flexible carrier of claim 1, wherein the branched low density polyethylene polymer comprises ethylene and another alpha-olefin comonomer.

4. The flexible carrier of claim 1, wherein the branched low density polyethylene polymer comprises a carbon monoxide comonomer.

5. The flexible carrier of claim 1, comprising not less than two and not more than twelve of the primary apertures.

6. The flexible carrier of claim 1, wherein the branched low density polyethylene polymer has a density of about 0.920–0.940 grams/cm$^3$.

7. The flexible carrier of claim 1, wherein the branched low density polyethylene polymer has a density of about 0.925–0.935 grams/cm$^3$.

8. The flexible carrier of claim 1, wherein the single-site catalyzed ethylene-alpha olefin copolymer plastomer comprises an alpha-olefin comonomer having 3–12 carbon atoms.

9. The flexible carrier of claim 8, wherein the alpha-olefin comonomer has 4–8 carbon atoms.

10. The flexible carrier of claim 1, wherein the single-site catalyzed ethylene-alpha olefin copolymer plastomer has a density of about 0.865–0.895 grams/cm$^3$.

11. The flexible carrier of claim 1, wherein the single-site catalyzed ethylene-alpha olefin copolymer plastomer has a density of about 0.880–0.890 grams/cm$^3$.

12. The flexible carrier of claim 1, wherein the polymer composition comprises about 70–97% by weight of the branched low density polyethylene polymer and about 3–30% by weight of the single-site catalyzed ethylene-alpha olefin copolymer plastomer.

13. The flexible carrier of claim 1, wherein the polymer composition comprises about 80–95% by weight of the branched low density polyethylene polymer and about 5–20% by weight of the single-site catalyzed ethylene-alpha olefin copolymer plastomer.

14. A flexible carrier for carrying a plurality of containers, comprising a flexible sheet and a plurality of primary apertures formed in the sheet for receiving portions of the containers, the flexible sheet comprising a polymer composition which includes:

about 50–99% by weight of an ethylene-carbon monoxide copolymer which includes a branched low density polyethylene polymer formed using a high pressure polymerization process and a carbon monoxide comonomer; and about 1–50% by weight of a single-site catalyzed ethylene-alpha olefin copolymer plastomer having a density of about 0.850–0.905 grams/cm$^3$.

15. The flexible carrier of claim 14, wherein the ethylene-carbon monoxide copolymer comprises about 0.1–20% by weight carbon monoxide.

16. The flexible carrier of claim 14, wherein the ethylene-carbon monoxide copolymer comprises about 0.5–10% by weight carbon monoxide.

17. The flexible carrier of claim 14, wherein the ethylene-carbon monoxide copolymer comprises about 1–4% by weight carbon monoxide.

18. The flexible carrier of claim 14, wherein the ethylene-carbon monoxide copolymer includes only ethylene and carbon monoxide comonomers.

19. The flexible carrier of claim 14, wherein the ethylene-carbon monoxide copolymer further includes another alpha-olefin comonomer.

20. The flexible carrier of claim 14, wherein the single-site catalyzed ethylene-alpha olefin copolymer plastomer comprises an alpha-olefin comonomer having 3–12 carbon atoms.

21. The flexible carrier of claim 20, wherein the alpha-olefin comonomer has 4–8 carbon atoms.

22. The flexible carrier of claim 20, wherein the plastomer comprises about 5–30% by weight of the alpha-olefin comonomer having 3–12 carbon atoms.

23. The flexible carrier of claim 20, wherein the plastomer comprises about 10–25% by weight of the alpha-olefin comonomer having 3–12 carbon atoms.

24. The flexible carrier of claim 14, comprising not less than two and not more than twelve of the primary apertures.

25. A flexible carrier for carrying a plurality of containers, comprising a flexible sheet and a plurality of primary apertures formed in the sheet for receiving portions of the containers, the flexible sheet comprising a polymer composition which includes:

about 50–99% of a branched low density polyethylene polymer produced by a high pressure process; and about 1–50% by weight of a single-site catalyzed ethylene-alpha olefin copolymer plastomer having a density of about 0.850–0.905 grams/cm$^3$.

26. The flexible carrier of claim 25, wherein the branched low density polyethylene polymer comprises an ethylene-carbon monoxide copolymer.

27. The flexible carrier of claim 25, wherein the single-site catalyzed ethylene-alpha olefin copolymer plastomer further includes a carbon monoxide comonomer.

28. The flexible carrier of claim 25, further comprising an ethylene-carbon monoxide copolymer.

29. The flexible carrier of claim 25, wherein the low density polyethylene polymer has a density of about 0.910–0.950 grams/cm$^3$.

30. The flexible carrier of claim 25, wherein the low density polyethylene polymer has a melt index of about 0.2–3.0 grams/10 min.

31. The flexible carrier of claim 25, wherein the low density polyethylene polymer has a melt index of about 0.3–1.5 grams/10 min.

32. The flexible carrier of claim 25, wherein the low density polyethylene polymer has a melt index of about 0.4–0.7 grams/10 min.

33. The flexible carrier of claim 25, wherein the plastomer has a melt index of about 0.3–10 grams/10 min.

34. The flexible carrier of claim 25, wherein the plastomer has a melt index of about 0.5–5 grams/10 min.

35. The flexible carrier of claim 25, wherein the plastomer has a melt index of about 0.8–1.3 grams/10 min.

36. The flexible carrier of claim 25, comprising not less than two and not more than twelve of the primary apertures.

* * * * *